US010619608B2

(12) United States Patent
Matsunaga et al.

(10) Patent No.: US 10,619,608 B2
(45) Date of Patent: Apr. 14, 2020

(54) LINK STRUCTURE

(71) Applicant: HONDA MOTOR CO., LTD., Tokyo (JP)

(72) Inventors: Yoshihiro Matsunaga, Wako (JP); Takeshi Sasajima, Wako (JP); Yasutomo Abe, Wako (JP); Yuki Oshida, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 102 days.

(21) Appl. No.: 15/955,890

(22) Filed: Apr. 18, 2018

(65) Prior Publication Data

US 2018/0313309 A1 Nov. 1, 2018

(30) Foreign Application Priority Data

Apr. 28, 2017 (JP) ..... 2017-089558

(51) Int. Cl.

| | |
|---|---|
| ***F02M 37/00*** | (2006.01) |
| ***F02M 37/08*** | (2006.01) |
| ***H01H 19/635*** | (2006.01) |
| ***F02B 63/04*** | (2006.01) |

(52) U.S. Cl.

CPC ..... *F02M 37/0017* (2013.01); *F02B 63/048* (2013.01); *F02M 37/0023* (2013.01); *F02M 37/0076* (2013.01); *F02M 37/08* (2013.01); *H01H 19/635* (2013.01); *F02M 2037/082* (2013.01)

(58) Field of Classification Search

CPC ..... F02M 37/0017; F02M 37/0023; F02M 37/0076; F02M 37/08; F02M 2037/082

USPC ..... 123/445

See application file for complete search history.

(56) References Cited

FOREIGN PATENT DOCUMENTS

| | | | | |
|---|---|---|---|---|
| JP | 57206743 A | * | 12/1982 | ..... F02D 11/04 |
| JP | 64-47948 | | 3/1989 | |
| JP | 2002-309959 | | 10/2002 | |
| JP | 2003049664 A | * | 2/2003 | |
| JP | 2004-293475 | | 10/2004 | |
| JP | 2005-105971 | | 4/2005 | |

OTHER PUBLICATIONS

JP200349664 A (Osanai et al.) (Feb. 21, 2003) [online] (retrieved on Oct. 10, 2019) (retrieved from espacenet).*
European Search Report dated Jun. 4, 2018, 7 pages.
European Office Action dated Jan. 29, 2020, 5 pages.

* cited by examiner

*Primary Examiner* — Mahmoud Gimie
(74) *Attorney, Agent, or Firm* — Rankin, Hill & Clark LLP

(57) ABSTRACT

To allow linking a fuel cock and an engine switch with a simple configuration and reducing residual fuel, a switch plate (link component) that links a fuel cock and an engine switch is provided. The switch plate includes: an extending portion (switch operation portion) pressed by a cam, which rotates integrally with the fuel cock, to switch off the engine switch when the fuel cock is further rotated beyond a position where the fuel cock is switched from ON to OFF; and a cam contact wall where the cam comes into contact to change rotational resistance of the fuel cock to allow providing a predetermined operation feeling when the fuel cock further rotates beyond the position where the fuel cock is switched from ON to OFF.

8 Claims, 9 Drawing Sheets

LINK STRUCTURE

INCORPORATION BY REFERENCE

The present application claims priority under 35 U.S.C. § 119 to Japanese Patent Application No. 2017-089558 filed on Apr. 28, 2017. The content of the application is incorporated herein by reference in its entirety.

BACKGROUND OF THE INVENTION

Field of the Invention

The present invention relates to a link structure of a fuel cock and an engine switch.

Description of the Related Art

A configuration of using a plurality of shafts coupled in a bendable manner to transmit power between a fuel cock and an engine switch and a configuration of using a link mechanism to transmit power are known as link structures of the fuel cock and the engine switch (for example, see Japanese Utility Model Publication Nos. 64-47948 and Japanese Patent Laid-Open No. 2005-105971).

A fuel cock integrated with an engine switch so as to open and close a contact point in conjunction with a rotation operation of a lever of the fuel cock is known as this type of link structure (for example, see Japanese Patent Laid-Open No. 2004-293475). The fuel cock of Japanese Patent Laid-Open No. 2004-293475 is provided with a notch mechanism for positioning associated with a click feeling at an operating position and a stop position of the engine.

However, the numbers of components are large in the conventional configurations. This complicates the structure and causes an increase in the weight or an increase in the size. While the conventional configurations can prevent the fuel cock from being left open when the engine switch is OFF, it is difficult to use up the fuel remaining between the fuel cock and a carburetor. When the fuel remains for a long time, the fuel is deteriorated, and this causes a poor start.

Accordingly, an object of the present invention is to allow linking a fuel cock and an engine switch with a simple configuration and reducing residual fuel.

SUMMARY OF THE INVENTION

To attain the object, the present invention provides a link structure of a fuel cock and an engine switch, the link structure including: a cam that rotates integrally with the fuel cock; and a link component that links the fuel cock and the engine switch, the link component including: a switch operation portion pressed by the cam to switch off the engine switch when the fuel cock is further rotated beyond a position where the fuel cock is switched from ON to OFF; and a cam contact wall where the cam comes into contact to change rotational resistance of the fuel cock to allow providing a predetermined operation feeling when the fuel cock is further rotated beyond the position where the fuel cock is switched from ON to OFF.

According to the configuration, the power transmission between the fuel cock and the engine switch can be realized only by the link component, and the number of components can be reduced. The operation of the engine can be continued even when the fuel cock is at the OFF position. In addition, the engine switch can be turned off with a small turn angle of the fuel cock from the OFF position, and the user can easily recognize whether the fuel cock is ON or OFF.

In the configuration, the cam contact wall is an inclined wall extending inside of the fuel cock in a radial direction from a retracted position outside of the fuel cock in the radial direction with respect to the cam at the time that the fuel cock is switched off.

According to the configuration, an operation feeling equivalent to a click feeling can be provided with a simple configuration. Furthermore, the operation feeling of the fuel cock can be easily adjusted by shape adjustment of an inclined angle of the cam contact wall or the like.

In the configuration, the engine switch is a press switch, and a contact position of the engine switch and the switch operation portion is set such that a moment acting on the link component from the engine switch through the switch operation portion after a press of the engine switch acts in a same direction as a moment acting on the link component when the cam comes into contact with the cam contact wall after rotation of the fuel cock toward an OFF side.

According to the configuration, the force generated by the moments can act on the link component in the same direction, and unnecessary motion of the link component can be prevented.

In the configuration, the link component is guided such that the link component is movable toward a side in which the switch operation portion switches off the engine switch. According to the configuration, motion in directions other than the guided direction can be prevented, and the movement of the link component can be smooth.

According to the present invention, the fuel cock and the engine switch can be linked with a simple configuration, and residual fuel can be easily reduced.

DETAILED DESCRIPTION OF THE PREFERRED EMBODIMENT

An embodiment of the present invention will now be described with reference to the drawings.

Figure 1:
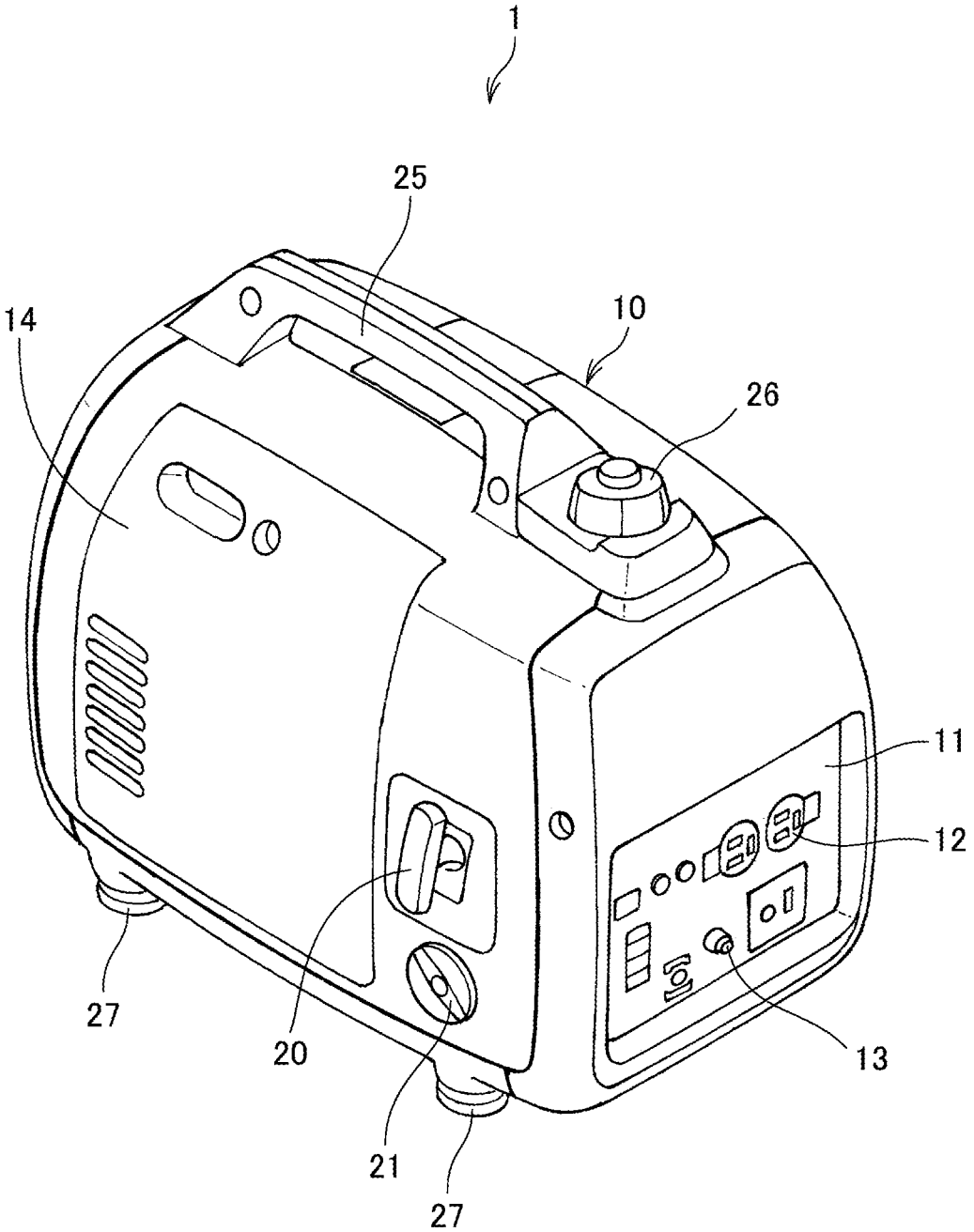
FIG. 1 is a perspective view showing an appearance of a power generation apparatus applying a link mechanism according to an embodiment of the present invention.

FIG. 1 is a perspective view showing an appearance of a power generation apparatus 1 applying a link structure according to the embodiment of the present invention.

As shown in FIG. 1, the power generation apparatus 1 includes a housing 10 that is a substantially rectangular solid, and a control panel 11 is installed on a side surface of the housing 10. Hereinafter, the surface provided with the control panel 11 will be referred to as a front surface.

Various terminals, such as a power outlet 12, and various operation switches, such as a frequency selector switch 13, and the like are provided on the control panel 11. A removable cover 14 is provided on a left side surface positioned on the left with reference to the front surface of the housing 10, and the cover 14 can be removed to access the inside of the housing 10.

A recoil starter 20 and a rotary fuel cock operation knob 21 (hereinafter, referred to as an operation knob 21) are exposed to the outside and provided on the left side surface of the housing 10, and the recoil starter 20 and the operation knob 21 can be operated from the outside. A handle 25 is provided on an upper surface of the housing 10, and a fuel cap 26 is exposed on a front surface side of the handle 25. The fuel cap 26 can be removed to supply fuel to a fuel tank 30 described later (FIG. 2 described later) in the power generation apparatus 1. A plurality of legs 27 that support the housing 10 are attached to a lower surface of the housing 10.

Figure 2:
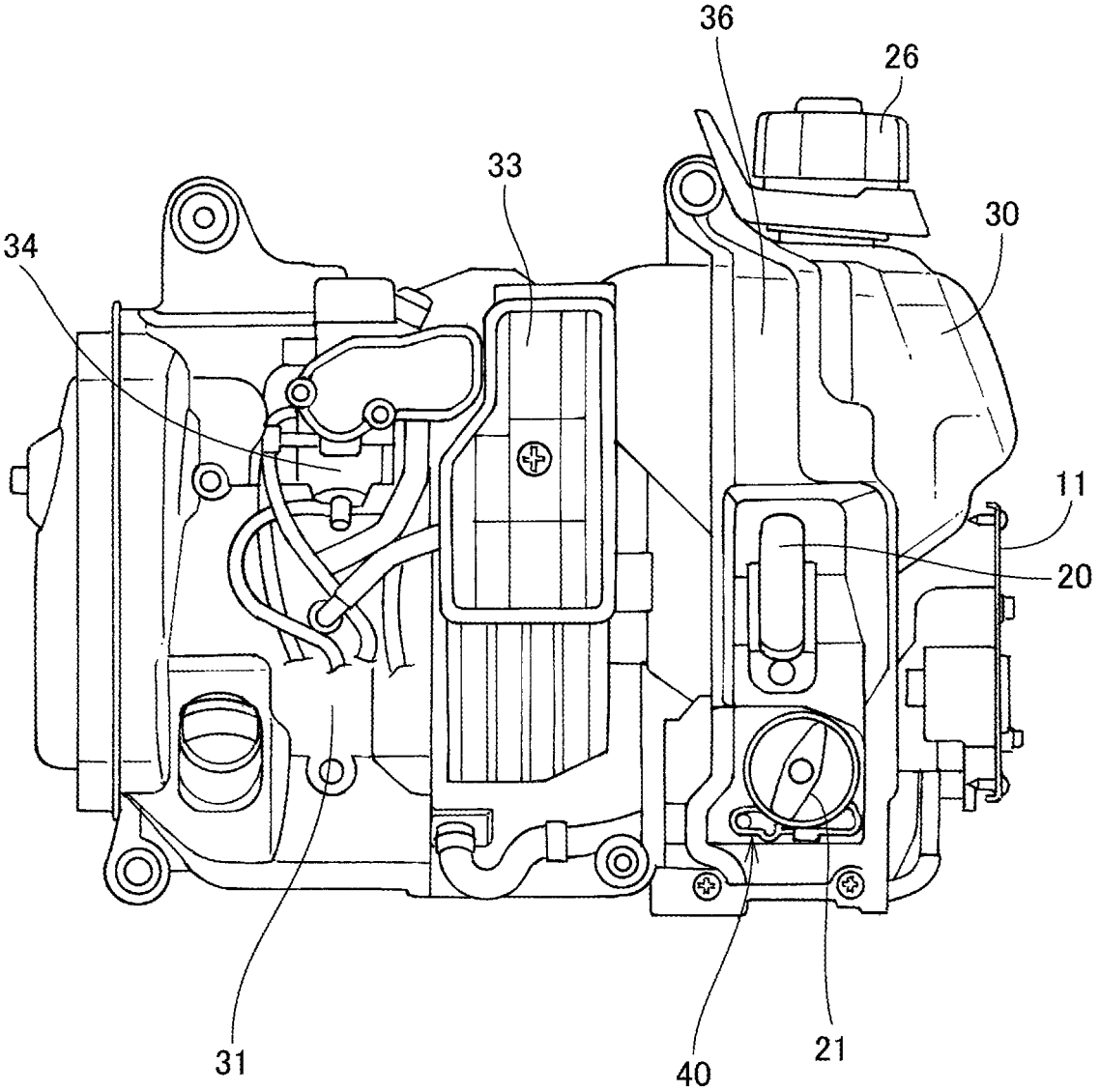
FIG. 2 is a diagram in which a housing is removed from the power generation apparatus.

FIG. 2 is a diagram in which the housing 10 is removed from the power generation apparatus 1. Note that a right direction in the drawing of FIG. 2 is equivalent to a front surface side of the power generation apparatus 1, and a left direction in the drawing is equivalent to a back surface side of the power generation apparatus 1.

The power generation apparatus 1 is provided with an engine 31 on a lower part near the back surface of the housing 10, and an air cleaner 33 and a carburetor 34 are arranged around the engine 31. The fuel tank 30 is arranged on an upper part near the front surface of the housing 10, and the recoil starter 20, an engine switch plate 40 (hereinafter, referred to as a switch plate 40), an engine switch 50 (FIG. 3 described later), and the like are arranged below the fuel tank 30.

The engine 31 is an internal combustion engine that uses gasoline as a fuel. An alternator not shown uses power of the engine 31 to generate electricity, and an inverter not shown converts the generated electricity into predetermined electric power. The electric power is supplied to the power outlet 12 and the like. A fuel pipe 35 (FIG. 3) extending from a fuel pump 31P (FIG. 3) is connected to the carburetor 34, and the fuel pump 31P supplies the fuel in the fuel tank 30 to the carburetor 34. The carburetor 34 supplies air cleaned by the air cleaner 33 and the fuel to the engine 31.

Note that the fuel of the engine 31 is not limited to gasoline, and the fuel may be other liquid fuel.

As shown in FIG. 2, a plate-like front frame (frame member) 36 extending in an up and down direction on the side of the fuel tank 30 is provided on the front side of the power generation apparatus 1. A fuel cock 21A, the switch plate 40, the engine switch 50, and the like are supported by the front frame 36.

Figure 3:
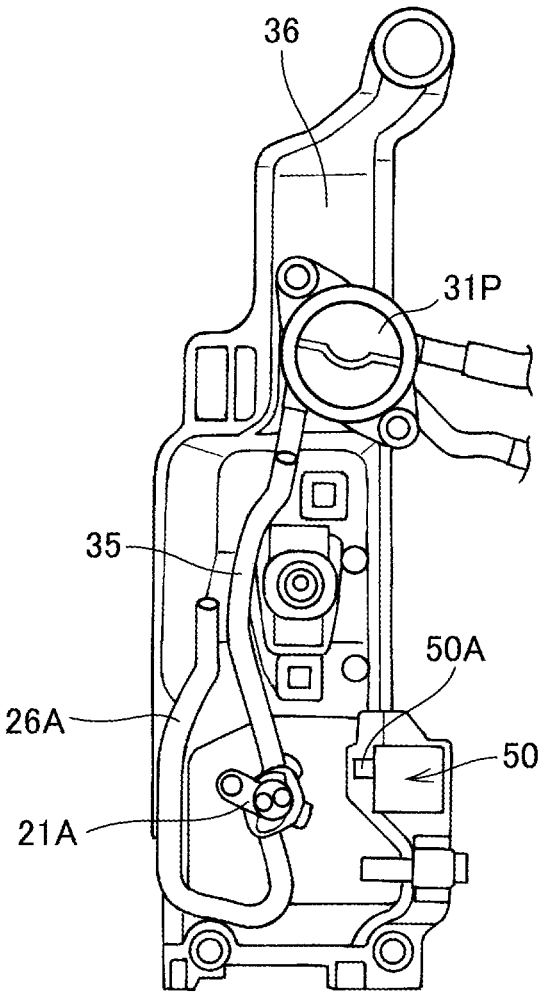
FIG. 3 is a diagram showing a front frame of the power generation apparatus along with a peripheral configuration as viewed from a back side of FIG. 2.

FIG. 3 is a diagram showing the front frame 36 along with a peripheral configuration as viewed from a back side of FIG. 2.

A fuel pipe 26A extending from the fuel pump 31P is arranged on a back side of the front frame 36, and the fuel cock 21A is provided on the fuel pipe 26A. A valve stem of the fuel cock 21A penetrates through the front frame 36, and the operation knob 21 is coupled to a tip of the fuel cock 21A.

The operation knob 21 rotates integrally with the fuel cock 21A. The fuel cock 21A is rotated and operated in a predetermined direction (clockwise in the present configuration) by the operation knob 21, and the fuel pipe 26A is switched from open to closed (the fuel cock 21A is switched from ON to OFF). The fuel cock 21A is rotated and operated in an opposite direction (counterclockwise in the present configuration) by the operation knob 21, and the fuel pipe 26A is switched from closed to open (the fuel cock 21A is switched from OFF to ON).

The engine switch 50 is a press type switch that switches on and off the engine 31, and as shown in FIG. 3, the engine switch 50 is arranged at substantially the same height as the fuel cock 21A. The engine switch 50 includes a protrusion 50A protruding toward the fuel cock 21A, and the protrusion 50A is pressed to switch off the engine 31.

The protrusion 50A is biased toward the fuel cock 21A by a biasing member (not shown) in the engine switch 50, and when the protrusion 50A is not pressed, the recoil starter 20 can start the engine 31 to continue the operation of the engine 31. The switch plate 40 is a link component that links the fuel cock 21A and the engine switch 50. The switch plate 40 will be described later.

Figure 4:
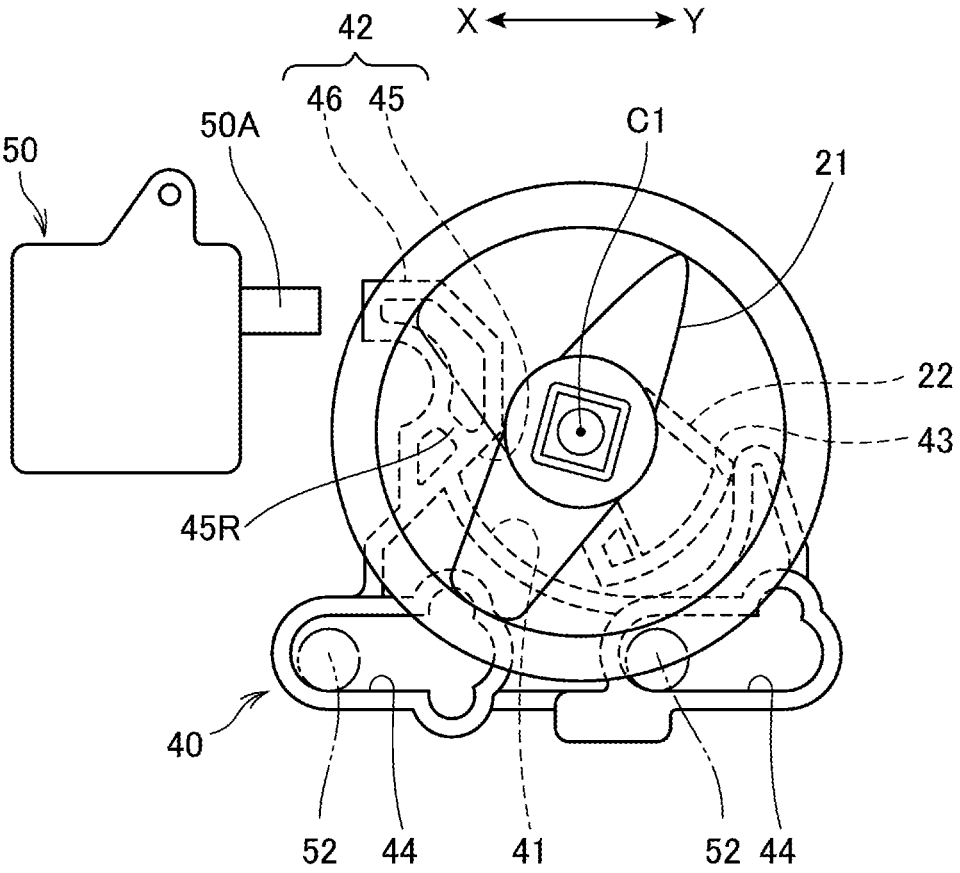
FIG. 4 is a diagram showing a link structure of a fuel cock and an engine switch.

FIG. 4 is a diagram showing a link structure of the fuel cock 21A and the engine switch 50.

As shown in FIG. 4, the switch plate 40 is arranged on a back side of the operation knob 21 that rotates integrally with the fuel cock 21A. The switch plate 40 is supported by pin-shaped support members 52 arranged at an interval on the front and the back, and the switch plate 40 is movable toward the engine switch 50. A cam 22 that rotates integrally with the operation knob 21 is provided on the operation knob 21, and the cam 22 moves the switch plate 40 toward the engine switch 50 or toward the opposite side thereof.

Hereinafter, a movement direction when the switch plate 40 moves toward the engine switch 50 will be referred to as an X direction, and a movement direction when the switch plate 40 moves toward the opposite side of the engine switch 50 will be referred to as a Y direction. In each of the drawings including FIG. 4, reference sign C1 denotes a shaft center common to the operation knob 21 and the fuel cock 21A (also coincides with the rotation center).

The switch plate 40 will be described.

Figure 5:
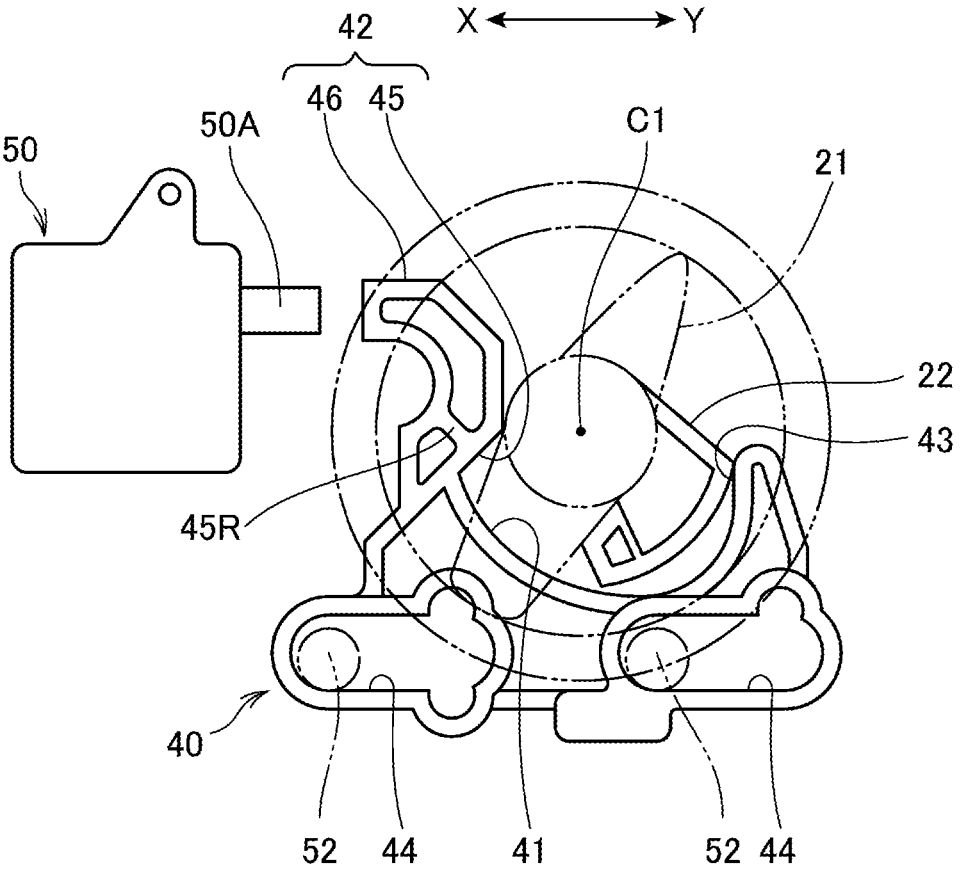
FIG. 5 is a diagram showing a switch plate along with a peripheral configuration.

FIG. 5 is a diagram showing the switch plate 40 along with a peripheral configuration. Note that in FIG. 5, solid lines indicate the switch plate 40 and the cam 22 of FIG. 4, and two-dot chain lines indicate the parts other than the cam 22 of the operation knob 21.

The switch plate 40 includes: a recessed portion 41 recessed to allow the cam 22 of the operation knob 21 to enter; a first end portion 42 provided on an end portion in the X direction of the recessed portion 41; and a second end portion 43 provided on an end portion in the Y direction of the recessed portion 41, wherein the recessed portion 41, the first end portion 42, and the second end portion 43 are integrated with the switch plate 40.

The switch plate 40 also includes guide grooves 44 in a long hole shape extending in the X and Y directions, the guide grooves 44 arranged at an interval on the front and the back. The support member 52 supported by the frame (the front frame 36 in the present configuration) of the power generation apparatus 1 is arranged on each of the guide grooves 44, and the guide grooves 44 and the support members 52 support the switch plate 40 such that the switch plate 40 is movable in the X and Y directions.

FIGS. 4 and 5 show a state in which the fuel cock 21A is rotated by the operation knob 21 toward the ON side (counterclockwise in FIGS. 4 and 5) until the cam 22 abuts the second end portion 43 of the switch plate 40, and the switch plate 40 is moved in the Y direction to the greatest extent. In this state, the fuel cock 21A is fully open, and the engine switch 50 is also ON because the switch plate 40 does not press the engine switch 50. Therefore, in the switch plate 40, the second end portion 43 forms an area in which the fuel cock 21A is fully open, and the cam 22 comes into contact while the engine switch 50 is at the ON position.

In the switch plate 40, the recessed portion 41 forms a movement area of the cam 22 while the fuel cock 21A is switched on or off. The recessed portion 41 is formed in a recessed shape that prevents the switch plate 40 from moving to the position for pressing the protrusion 50A of the engine switch 50 while the cam 22 moves in the area equivalent to the recessed portion 41.

More specifically, the recessed portion 41 is formed in a recessed shape extending in the circumferential direction of the operation knob 21, outside of the operation knob 21 in the radial direction with respect to the moving cam 22, to hold the switch plate 40 at a position not pressing the protrusion 50A of the engine switch 50. Note that the outside of the operation knob 21 in the radial direction coincides with the outside of the fuel cock 21A in the radial direction, and the circumferential direction of the operation knob 21 coincides with the circumferential direction of the fuel cock 21A.

As a result, the engine switch is held in the ON state while the fuel cock 21A is switched on or off by the operation knob 21.

In the switch plate 40, the first end portion 42 forms a contact area (movement area) of the cam 22 while the fuel cock 21A further rotates in the OFF state after the fuel cock 21A is switched off. The first end portion 42 includes a cam contact wall 45 that is an inclined wall extending inside of the operation knob 21 in the radial direction from a retracted position outside of the operation knob 21 in the radial direction with respect to the cam 22 after the fuel cock 21A is switched off.

The cam 22 of the fuel cock 21A in the OFF state comes into contact with the cam contact wall 45, and the cam 22 also comes into contact with the cam contact wall 45 while the fuel cock 21A is further rotated (rotated clockwise) in the OFF state. Since the cam contact wall 45 extends inside of the operation knob 21 in the radial direction with respect to the cam 22, the cam contact wall 45 forms a step that the cam 22 moving in the rotation direction of the operation knob 21 climbs over. Therefore, the amount of the cam 22 pushing out the cam contact wall 45 in the X direction can be large even if a turn angle of the operation knob 21 is relatively small. As a result, an extending portion 46 described later of the switch plate 40 can switch off the engine switch 50 at once with a small turn angle.

In this case, since the cam 22 pushes out the cam contact wall 45 in the X direction with a small turn angle, the frictional force between the cam 22 and the switch plate 40 increases, and the rotational resistance (equivalent to force required for clockwise rotation) of the operation knob 21 increases.

Figure 6A:
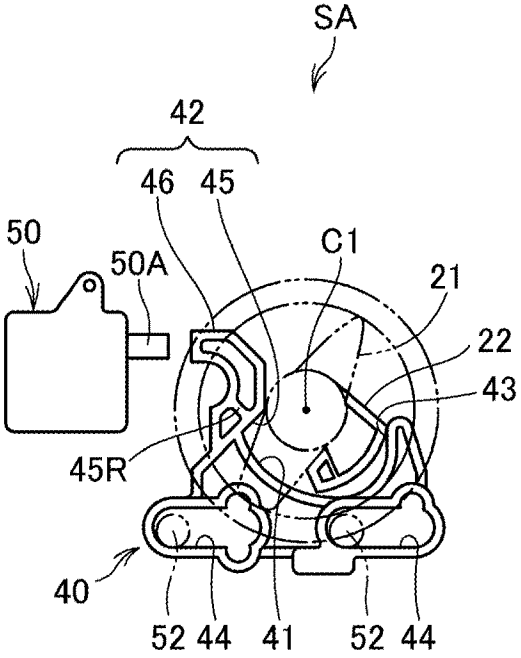
FIG. 6A is a diagram showing a state in which the fuel cock is rotated and operated to an ON position and to a fully open position.
Figure 6B:
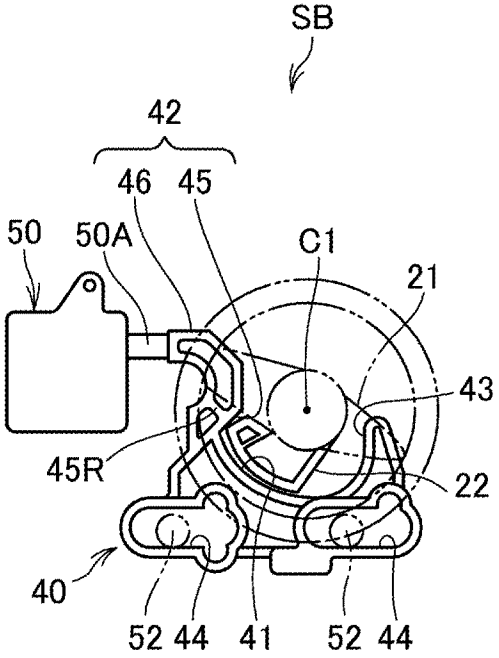
FIG. 6B is a diagram showing a state in which a cam of the fuel cock comes into contact with a cam contact wall.

As shown in FIG. 6B described later, the extending portion 46 described later of the switch plate 40 abuts the protrusion 50A of the engine switch 50 while the cam 22 is in contact with the cam contact wall 45. Therefore, the force biasing the protrusion 50A in the Y direction acts as force (reaction force) pressing the cam contact wall 45 against the cam 22, and the operation knob 21 needs to be rotated clockwise against the biasing force. Therefore, the rotational resistance (equivalent to force required for clockwise rotation) of the operation knob 21 further increases by the amount of the biasing force of the protrusion 50A.

When the cam 22 climbs over the step generated by the cam contact wall 45, the increase in the rotation resistance of the operation knob 21 stops. As a result, an operation feeling equivalent to a click feeling is provided.

Note that change characteristics, such as strength of the rotational resistance of the operation knob 21 caused by the cam contact wall 45, that is, change characteristics of the force required for the rotation operation of the fuel cock 21A, can be easily adjusted by adjusting the inclined angle of the cam contact wall 45 or by changing the shape of the inclination.

The first end portion 42 includes the extending portion 46 extending from the cam contact wall 45 toward the protrusion 50A of the engine switch 50. The extending portion 46 is moved by the cam 22 toward the engine switch 50 to press the protrusion 50A of the engine switch 50 in the X direction when the fuel cock 21A further rotates beyond the OFF position from the state in which the cam 22 is brought into contact with the cam contact wall 45 by the operation knob 21 (see FIG. 6C described later). Therefore, the extending portion 46 functions as a switch operation portion that turns off the engine switch 50 according to the movement of the cam 22.

A resin material is used to manufacture the switch plate 40 by integral molding. In this case, a hollow is provided inside of the switch plate 40 as shown in FIG. 5, and the weight of the entire switch plate 40 is reduced. The switch plate 40 is also provided with a rib 45R in an area of the cam contact wall 45, and the rib 45R reinforces the cam contact wall 45.

Next, an operation of the link structure of the fuel cock 21A and the engine switch 50 will be described.

Figure 6C:
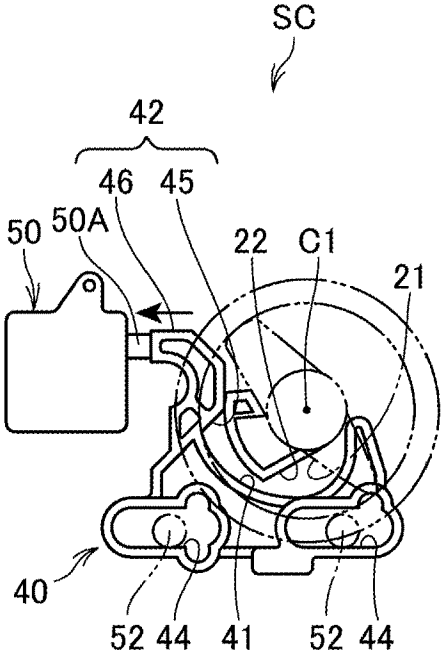
FIG. 6C is a diagram showing a state in which the fuel cock is further rotated from the state in which the cam is in contact with the cam contact wall.
Figure 7:
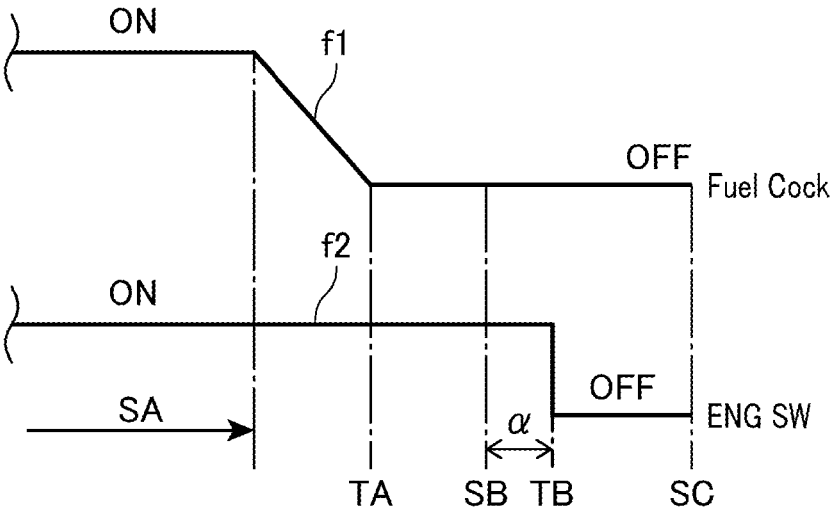
FIG. 7 is a diagram showing changes in ON/OFF of the fuel cock and the engine switch.

FIGS. 6A to 6C show a case in which the fuel cock 21A is further rotated and operated by the operation knob 21 beyond the OFF position from the ON position. FIG. 7 is a diagram showing changes in ON (ON in FIG. 7) and OFF (OFF in FIG. 7) of the fuel cock 21A and the engine switch 50. Note that in FIG. 7, reference sign f1 denotes a characteristic curve of the fuel cock 21A, and reference sign f2 shows a characteristic curve of the engine switch 50.

As shown in FIG. 6A, when the fuel cock 21A is rotated and operated by the operation knob 21 to the ON position and to the fully open position, the cam 22 comes into contact with the second end portion 43 of the switch plate 40. In this case, the switch plate 40 is at a position retracted to the greatest extent from the engine switch 50, and the engine switch 50 is ON. The state in which both the fuel cock 21A and the engine switch 50 are ON will be referred to as a state SA (see FIG. 7).

When the fuel cock 21A is rotated and operated by the operation knob 21 toward the OFF side from the state SA, the cam 22 abuts the cam contact wall 45 of the first end portion 42 of the switch plate 40 as shown in FIG. 6B. The state shown in FIG. 6B will be referred to as a state SB.

As shown in FIG. 7, there is a timing TA that the fuel cock 21A is switched from ON to OFF between the state SA and the state SB. Therefore, the fuel cock 21A is OFF, and the engine switch 50 is ON in the state SB.

In the state SB, the cam 22 abuts the cam contact wall 45 as shown in FIG. 6B. Therefore, when the fuel cock 21A is further rotated clockwise by the operation knob 21, a large amount of movement of the switch plate 40 can be secured even if the turn angle of the fuel cock 21A is small. As a result, the engine switch 50 can be switched off with a small turn angle after the fuel cock 21A is turned off.

Since the cam 22 abuts the cam contact wall 45, the frictional resistance between the cam 22 and the cam contact wall 45 increases when the fuel cock 21A is further rotated clockwise by the operation knob 21. As a result, the rotational resistance in rotating the fuel cock 21A increases, and the force required for the operation of the fuel cock 21A increases.

Moreover, the extending portion 46 of the switch plate 40 abuts the protrusion 50A of the engine switch 50 in the case of the state SB. Therefore, the fuel cock 21A needs to be rotated against the biasing force of the protrusion 50A. The rotational resistance of the fuel cock 21A further increases by the amount of the biasing force, and the force required for the operation of the fuel cock 21A further increases.

Once the fuel cock 21A is rotated and operated by the operation knob 21 against the biasing force of the extending portion 46, the increase in the rotational resistance of the fuel cock 21A stops when the cam 22 climbs over the cam contact wall 45.

In this way, the rotational resistance of the fuel cock 21A is changed from increase to decrease in a short time along with the clockwise rotation of the fuel cock 21A starting from the state SB. This allows the user to recognize a so-called one click feeling.

As shown in FIG. 7, the engine switch 50 is switched from ON to OFF by the extending portion 46 of the switch plate 40 at a timing TB just after the state SB, and the click feeling can be provided between the state SB and the timing TB (indicated by reference sign a in FIG. 7). As a result, the user can easily recognize that the fuel cock 21A is switched off while the engine switch 50 is ON.

When the fuel cock 21A is further rotated and operated by the operation knob 21 beyond the OFF position from the timing TB, the cam 22 climbs over the cam contact wall 45 of the switch plate 40 as shown in FIG. 6C. The state shown in FIG. 6C will be referred to as a state SC.

In the state SC, the reaction force from the protrusion 50A acts as force that restricts the rotation of the fuel cock 21A through the cam 22, and the fuel cock 21A and the engine switch 50 are held in the OFF state.

Figure 8:
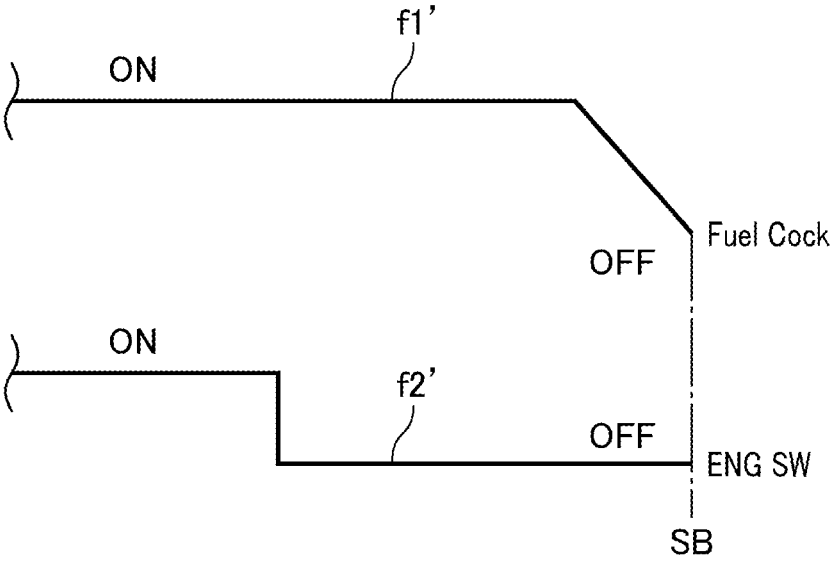
FIG. 8 is a diagram showing changes in ON/OFF of a fuel cock and an engine switch in a reference example.

Here, FIG. 8 shows a reference example of a configuration in which the engine switch 50 is switched from ON to OFF while the fuel cock 21A is switched from ON to OFF. In FIG. 8, reference sign f1' shows a characteristic curve of the fuel cock 21A, and reference sign f2' shows a characteristic curve of the engine switch 50.

According to the reference example, the fuel cock 21A is switched off after the engine switch 50 is switched off. Therefore, the fuel remaining between the fuel cock 21A and the carburetor 34 cannot be used to operate the engine 31.

On the other hand, in the present configuration, the engine switch 50 is ON at the position where the fuel cock 21A is switched from ON to OFF as shown in FIG. 7. Therefore, the operation of the engine 31 can be continued even when the fuel cock 21A is at the OFF position. As a result, the fuel remaining between the fuel cock 21A and the carburetor 34 can be used to operate the engine 31.

Moreover, the user can have the operation feeling that allows recognizing that the fuel cock 21A is switched off while the engine switch 50 is in the ON state. Therefore, the user can easily recognize whether the fuel cock 21A is ON or OFF. As a result, the fuel remaining between the fuel cock 21A and the carburetor 34 can be easily used up, and the toughness against a poor start caused by a deterioration of fuel can be improved.

Furthermore, the cam 22 and the switch plate 40 link the fuel cock 21A and the engine switch 50. Therefore, the number of components can be small, and this can reduce the complication of the structure, the increase in the weight, and the increase in the size.

Next, an arrangement of the switch plate 40 and the engine switch 50 will be described.

Figure 9:
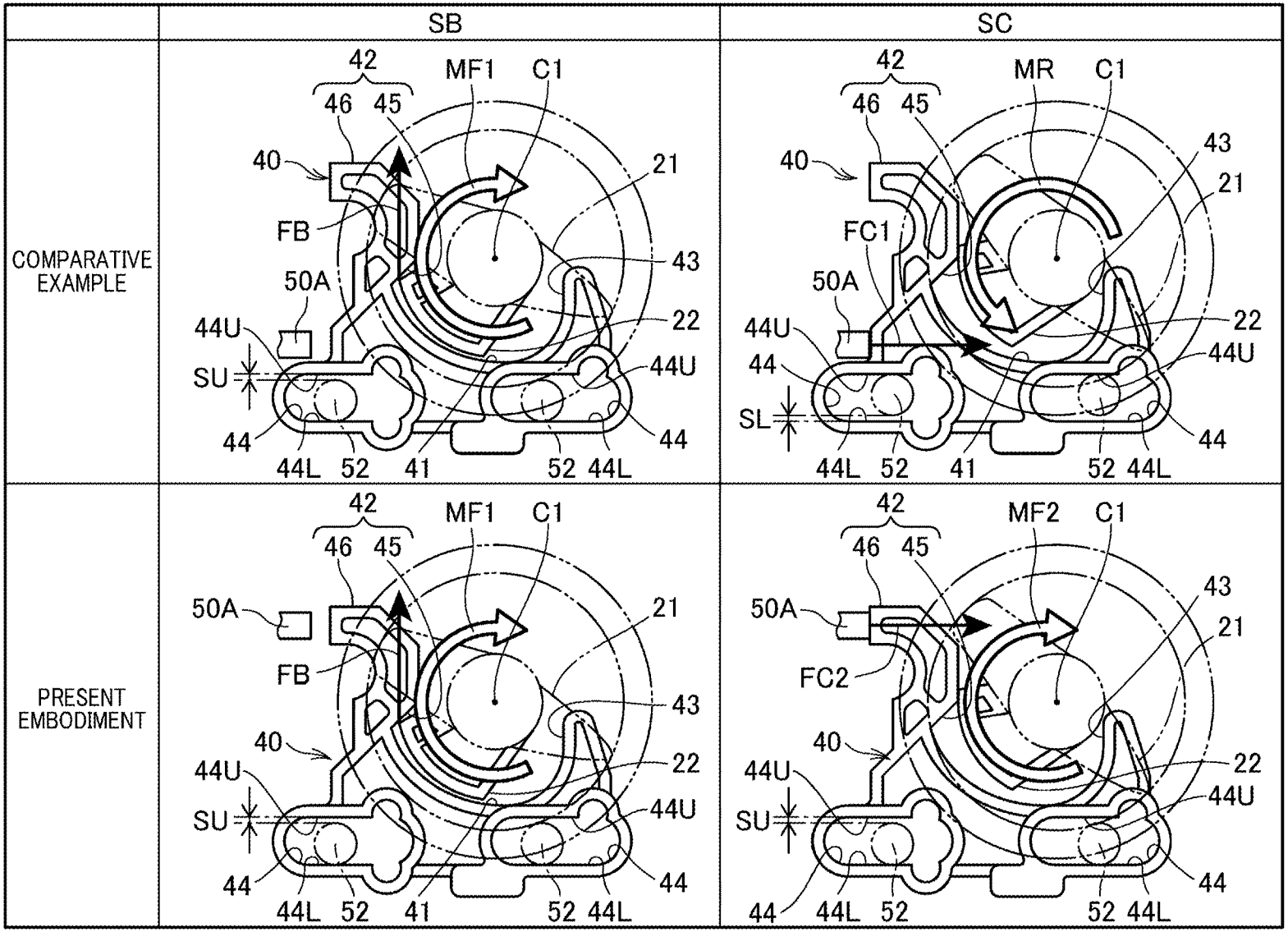
FIG. 9 is a diagram illustrating arrangement configurations of a comparative example and the present embodiment.

FIG. 9 is a diagram illustrating a comparative example showing another arrangement of the switch plate 40 and the engine switch 50 and an arrangement configuration of the present embodiment.

The comparative example shown in FIG. 9 is different in that the position of the protrusion 50A of the engine switch 50 is a position lower than in the present embodiment.

In the comparative example, the switch plate 40 abuts the protrusion 50A in the state SC. Therefore, a moment MR that rotates the fuel cock 21A toward the ON side (counterclockwise in FIG. 9) is generated by reaction force FC1 acting from the protrusion 50A.

The moment MR moves the switch plate 40 downward as shown in FIG. 9, and internal upper surfaces 44U of the guide grooves 44 of the switch plate 40 abut upper ends of the support members 52. Therefore, a gap SL is formed between a lower end of the support member 52 and an internal lower surface 44L of the guide groove 44.

On the other hand, in the state SB, the engine switch 50 and the switch plate 40 are separated both in the comparative example and the present embodiment. Therefore, upward force FB indicated by an arrow FB in FIG. 9 is generated in the switch plate 40 due to abutment force of the cam 22 and the cam contact wall 45. The force FB generates a moment MF1 that rotates the fuel cock 21A clockwise.

The moment MF1 moves the switch plate 40 upward, and the internal lower surfaces 44L of the guide grooves 44 of the switch plate 40 abut the lower ends of the support members 52. Therefore, a gap SU is formed between the upper end of the support member 52 and the internal upper surface 44U of the guide groove 44.

In this way, in the comparative example, the position of the gap (gaps SU and SL) between the support member 52 and the guide groove 44 changes upward and downward between the states SB and SC, and therefore, there is up and down motion of the switch plate 40. As a result, when the switch plate 40 moves toward the engine switch 50, vibration is generated in the perpendicular direction relative to the movement direction (X direction) in the comparative example.

On the other hand, in the present embodiment, a moment MF2 that rotates the fuel cock 21A toward the OFF side (clockwise in FIG. 9) is generated by reaction force FC2 of the action of the switch plate 40 from the protrusion 50A in the state SC as shown in FIG. 9. Note that only the part that the reaction force FC2 acts on the switch plate 40 is different from the reaction force FC1.

Therefore, the position of the gap (gap SU) between the support member 52 and the guide groove 44 is the same position in the states SB and SC in the present embodiment, and there is no up and down motion of the switch plate 40. As a result, when the switch plate 40 moves toward the engine switch 50, there is no vibration in the perpendicular direction relative to the movement direction (X direction), and the switch plate 40 can be smoothly moved.

As described, the switch plate 40 (link component) that links the fuel cock 21A and the engine switch 50 is provided in the configuration of the present embodiment, and under the configuration, the switch plate 40 is configured as follows.

The switch plate 40 includes: the extending portion 46 (switch operation portion) that is pressed by the cam 22 rotating integrally with the fuel cock 21A to switch off the engine switch 50 when the fuel cock 21A is further rotated beyond the position where the fuel cock 21A is switched from ON to OFF; and the cam contact wall 45 where the cam 22 comes into contact to change the rotational resistance of the fuel cock 21A to allow providing the operation feeling equivalent to the click feeling when the fuel cock 21A is further rotated beyond the position where the fuel cock 21A is switched from ON to OFF.

According to the configuration, the power transmission between the fuel cock 21A and the engine switch 50 can be realized just by the switch plate 40, and the number of components can be smaller than in the conventional configuration including a link mechanism and a notch mechanism. This can reduce the complication of the structure, the increase in the weight, and the increase in the size.

Furthermore, the operation of the engine 31 can be continued even when the fuel cock 21A is at the OFF position. In addition, the engine switch 50 can be turned off with a small turn angle of the fuel cock 21A from the OFF position, and the user can easily recognize whether the fuel cock 21A is ON or OFF. Therefore, the fuel cock 21A and the engine switch 50 can be linked with a simple configuration, and the residual fuel can be easily reduced.

Furthermore, the cam contact wall 45 is formed by the inclined wall extending inside of the fuel cock 21A in the radial direction from the retracted position outside of the fuel cock 21A in the radial direction with respect to the cam 22 at the time that the fuel cock 21A is switched off. According to the configuration, the click feeling can be provided with a simple configuration, and the operation feeling of the fuel cock 21A can be easily adjusted by shape adjustment of the inclined angle of the cam contact wall 45 or the like. For example, the shape is not limited to the shape providing the click feeling, and the shape may be changed to a shape providing another operation feeling.

In the present configuration, as shown in the state SC of FIG. 9, the contact position of the engine switch 50 and the extending portion 46 of the switch plate 40 is set such that the moment MF2 acting on the switch plate 40 from the engine switch 50 through the extending portion 46 after the press of the engine switch 50 acts in the same direction as the moment MF1 (state SB in FIG. 9) acting on the switch plate 40 when the cam 22 comes into contact with the cam contact wall 45 after the rotation of the fuel cock 21A toward the OFF side.

According to the configuration, the force generated by the moments MF1 and MF2 can act on the switch plate 40 in the same direction, and unnecessary motion (up and down motion in the present configuration) of the switch plate 40 can be prevented.

Furthermore, the switch plate 40 is guided such that the switch plate 40 is movable toward the side in which the extending portion 46 (switch operation portion) switches off the engine switch 50. Therefore, the motion in directions other than the guided direction can be prevented, and the movement of the switch plate 40 can be smooth.

The embodiment is just a mode for carrying out the present invention, and the embodiment can be arbitrarily modified and applied without departing from the scope of the present invention.

For example, the shapes of the switch plate 40 and the cam 22 are not limited to the shapes, and the shapes may be appropriately changed. The movement direction of the switch plate 40 is not limited to the horizontal direction, and the movement direction may be appropriately changed to the vertical direction or the like. The arrangement relationship between the switch plate 40 and the engine switch 50 may also be appropriately changed.

The engine switch 50 may be various well-known switches that can be turned on and off by the switch plate 40, and the engine switch 50 may not be limited to the press type.

Although the fuel of the engine 31 is liquid fuel in the case described in the embodiment, the fuel is not limited to this, and the fuel may be gas fuel, such as LP gas. In the case of the gas fuel, a gas supply port can be provided in place of the fuel tank 30, or a cassette gas can be arranged.

Although the present invention is applied to the link structure applied to the power generation apparatus 1 in the described case, the present invention is not limited to this. The present invention can be widely applied to various well-known apparatuses including the fuel cock 21A and the engine switch 50.

REFERENCE SIGNS LIST

1 power generation apparatus
21 fuel cock operation knob
21A fuel cock
26A fuel pipe
31 engine
34 carburetor
40 engine switch plate (link component)
44 guide groove
45 cam contact wall
46 extending portion (switch operation portion)
50 engine switch
50A protrusion
52 support member
C1 shaft center of fuel cock
MR, MF1, MF2 moments
SL, SU gaps

What is claimed is:

1. A link structure of a fuel cock and an engine switch, the link structure comprising:

a cam that rotates integrally with the fuel cock; and a link component that links the fuel cock and the engine switch, the link component comprising:

a recessed portion recessed to allow the cam to enter the recessed portion, wherein the recessed portion forms a movement area of the cam while the fuel cock is switched ON or OFF; and a first end portion provided on an end portion of the recessed portion at a side of the engine switch, wherein the first end portion has a cam contact wall with which the cam comes into contact to change a rotational resistance of the fuel cock to allow providing a predetermined operation feeling when the fuel cock further rotates beyond a position where the fuel cock is switched from ON to OFF;

wherein the link component is configured to be pressed by the cam and configured to move to the side of the engine switch when the cam abuts the cam contact wall of the first end portion and the fuel cock is further rotated beyond the position where the fuel cock is switched from ON to OFF; and wherein the link component has a switch operation portion to switch off the engine switch when the link component moves to the side of the engine switch.

2. The link structure according to claim 1, wherein the cam contact wall is an inclined wall extending inside of the fuel cock in a radial direction from a retracted position outside of the fuel cock in the radial direction with respect to the cam at the time that the fuel cock is switched off.

3. The link structure according to claim 1, wherein the engine switch is a press switch, and a contact position of the engine switch and the switch operation portion is set such that a moment acting on the link component from the engine switch through the switch operation portion after a press of the engine switch acts in a same direction as a moment acting on the link component when the cam comes into contact with the cam contact wall after rotation of the fuel cock toward an OFF side.

4. The link structure according to claim 3, wherein the link component is guided such that the link component is movable toward a side in which the switch operation portion switches off the engine switch.

5. The link structure according to claim 2, wherein the engine switch is a press switch, and a contact position of the engine switch and the switch operation portion is set such that a moment acting on the link component from the engine switch through the switch operation portion after a press of the engine switch acts in a same direction as a moment acting on the link component when the cam comes into contact with the cam contact wall after rotation of the fuel cock toward an OFF side.

6. The link structure according to claim 5, wherein the link component is guided such that the link component is movable toward a side in which the switch operation portion switches off the engine switch.

7. The link structure according to claim 1, wherein the recessed portion is formed in a recessed shape extending in the circumferential direction of the cam, outside of the cam in the radial direction.

8. The link structure according to claim 1, wherein the link component has a guide component that guides linear movement of the link component toward the engine switch or toward the opposite side thereof.

* * * * *